US005549957A

United States Patent [19]

Negola et al.

[11] Patent Number: 5,549,957

[45] Date of Patent: Aug. 27, 1996

[54] BULKED CONTINUOUS FILAMENT CARPET YARN

[76] Inventors: Edward J. Negola, 1007 Riverbend Dr., Atlanta, Ga. 30339; James R. Kennedy, 4531 King Springs Rd., Smyrna, Ga. 30082

[21] Appl. No.: 82,222

[22] Filed: Jun. 24, 1993

Related U.S. Application Data

[63] Continuation-in-part of Ser. No. 910,426, Jul. 8, 1992, abandoned.

[51] Int. Cl.[6] ..... B32B 3/02; D02G 3/00

[52] U.S. Cl. ..... 428/92; 428/97; 428/370; 428/373

[58] Field of Search ..... 428/92, 373, 97, 428/370

[56] References Cited

U.S. PATENT DOCUMENTS

| | | | |
|---|---|---|---|
| 3,551,279 | 12/1970 | Ando et al. | 428/373 |
| 3,803,453 | 4/1974 | Hull | 428/373 |
| 4,473,617 | 9/1984 | van Leeuwen et al. | 428/373 |
| 5,108,838 | 4/1992 | Tung | 428/92 |
| 5,202,185 | 4/1993 | Samuelson | 428/373 |
| 5,244,614 | 9/1993 | Hagen | 264/78 |

*Primary Examiner*—Terrel Morris

[57] ABSTRACT

A bi-component, multifilament synthetic dyeable carpet face yarn that is manufactured using the sheath-core melt spinning process is constructed so as to include a plurality of individual uniformly sheath-cored filaments having a sheath of virgin polyamide (e.g., nylon) and a polymer core that cannot be dyed using standard atmospheric pressure carpet dyeing methods used to dye the sheath filaments. This yarn is a less expensive substitute for 100% polyamide tufted carpet face yarn.

4 Claims, No Drawings

BULKED CONTINUOUS FILAMENT CARPET YARN

This application is a continuation in part of U.S. application Ser. No. 07/910,426, filed Jul. 8, 1992 now abandoned.

BACKGROUND OF INVENTION

The present invention relates to a new bi-component synthetic dyeable carpet face yarn that is manufactured using the sheath-core melt spinning process. This carpet yarn is an endless multifilament yarn comprised of a plurality of individual uniformly sheath-cored filaments having a dyeable sheath of virgin polyamide and a polymer core that can not be dyed using standard atmospheric pressure carpet dyeing methods. This yarn is a less expensive substitute for 100% Polyamide tufted carpet face yarn. It is made by a process that can use substantially reclaimed resin making it an invention that is both economically and environmentally beneficial.

The present invention finds a primary application in the tufted carpet industry. The tufted carpet industry uses undyed yarns as face yarns to create tufted carpet greige goods. In the manufacture of tufted carpeting, the face yarns used in the process, account for at least 68% of the cost of the finished product. Face yarn constitutes the major cost component in the manufacture of carpet. The other major costs to manufacture carpet are the dyeing of the carpet or greige goods. Carpets are almost always dyed by a standard atmospheric dyeing process. In the dyeing process, the carpet is subjected to a bath of dyes, chemicals and water at elevated temperatures. The dye attaches chemically to the yarn and the result is a desirable color shade. Yarns used constitute the major portion of expense while the dyeing of the fabric constitutes the second most expensive manufacturing step.

There are two common types of synthetic dyeable yarn available to the tufted carpet industry, Polyester and Polyamide. The Polyamide yarns are dyeable at standard atmospheric pressure eliminating expensive pressure vessels and harsh chemical carriers needed to dye Polyester. Therefore, the tufted carpet industry uses 90% polyamide as face yarns to manufacture carpet dyeable at atmospheric pressure. Polyamide yarns are dyeable because amine ends are used in its manufacture. These amine ends are receptive to the most common acid dyes used in the tufted carpet industry. Polyamide yarns are called by the generic trade name nylon. There are two common trade names for nylon, Nylon 6 or Nylon 6/6. Both are dyeable using standard atmospheric pressure in concert with acid dyes. They are well known to those skilled in the art.

As Reader says in U.S. Pat. No. 4,406,310 "Since carpets must be both functional and aesthetic the characteristics of the face yarns inserted into the fabric and the ability to apply desired colors to such yarns and tufted carpets and the tufting design are very important in determining marketability of the final carpets." In addition to ease of dyeing carpeting must withstand repeated stress under various traffic pressure. Because Nylon stands up to heavy traffic and its ease of dyeing, it is the yarn of choice in the tufted carpet industry. Nylon is the primary raw material for approximately 68% (1.2 billion pounds) of the total synthetic tufted carpet industry.

Synthetic fibers and yarns are all based on the huge petrochemical industry. Nylon is a direct product of the refining process and increases in price in direct proportion to the price of oil. Nylon is only available from a small number of large manufacturers. This limited number of suppliers is due to the capital intensive equipment required to polymerize nylon. Although it is desirable to produce a less expensive substitute for carpet nylon. The solution to this problem has been difficult to achieve.

Specifically, to qualify as a nylon substitute face yarn in the tufted carpet industry, the yarn must have the following characteristics:

1. superior recovery from crushing or compression
2. The ability to be tufted at high speeds
3. The ability to apply desired color on conventional dyeing equipment at atmospheric pressure
4. Strength to resist heavy foot traffic
5. A good bulking characteristic to give coverage with out using too much material (texturing potential)

No other synthetic carpet materials except nylon possess all the previously named five desired qualities.

The manufacturer of tufted nylon carpet can achieve many desirable color effects from undyed greige goods. For example, the carpet can be dyed into many different shades of solid colors, printed with floral or geometric designs, or sprayed with computer assisted equipment for tonal effects. While using nylon other special effects can be achieved in the dyeing and treatment of the yarn. This includes the application of stain repellents, anti-microbial and multicolored space dyeing.

It is known in patents that a sheath core system of manufacture may be used to make a sheath-core bi-component fibers. The following is a review of prior art concerning sheath-core patents.

Sheath-core techniques using different cross sections and differing materials to produce desired yarn characteristics are well known in the art. The Matsui U.S. Pat. No. 3,700,544 clearly teaches improved flexural rigidity due to an appropriate non-circular shape given to the cross section of the core. Matsui's examples all specify quenching the drawn filaments in 100 centigrade water for between ten and fifteen minutes. Those skilled in the art would recognize these as laboratory conditions impractical for the commercial production of carpet yarn.

Lin Fa Lee U.S. Pat. No. 3,992,499 shows that it is possible to extrude two filaments of differing dyeability using a sheath core system of feeding two molten polymers to a special spinnerette. It is clear that the invention teaches how to dye heather effects for apparel by varying the amount of polymer having differing dye receptors. The yarn sizes in each example limit the use of the invention to apparel applications. This invention does not teach any practical carpet yarn applications to one skilled in the art.

Hull U.S. Pat. No. 3,803,453 teaches that a polyethylene sheath with a core of carbon can be co-extruded with nylon to create a synthetic filament having a superior conductive property to eliminate static. The sheathed core filament is a minor portion of total yarn bundle. FIG. 2. shows that only a small percentage of cored filaments are required in order to eliminate static electricity.

Leeuwen et al. U.S. Pat. No. 4,474,617 teaches a bi-component multifilament that has a pigmented core while retaining a high tenacity suitable for use in seat belts, fishing nets and ropes. The object is to protect seat belt, nets, and rope manufacturing equipment from unnecessary pigment abrasion. This invention has no applicability to the manufacture of carpet face yarn.

Saito et al. U.S. Pat. No. 4,987,030 teaches that by melt spinning a bi-component sheath core process using a high intrinsic viscosity polyethylene terephthalate core and a polyamide sheath composed mainly of polyhexamethylene adipamide (Nylon 66) it is possible to produce a superior tire cord yarn that has excellent adhesion to rubber. The specifications call for a core material using a high IV of preferably 0.90 and yielding a high tenacity conjugated fiber. The high intrinsic viscosity raw material which Saito uses is much too expensive to be used in the manufacture of carpet yarn. The high tenacity requirement for tire cord yarn is not required for a carpet face yarn.

Schipper et al. U.S. Pat. No. 4,019,311. uses the principles of bi-component sheath-core and side by side extrusion. The concept clearly states that a stretch ratio of 1:1.25 to 1:2.5 be maintained in order to achieve the desired results. The invention uses the second stage of stretching to break filaments causing them to twist around the other dissimilar filaments thus producing a yarn that feels as if it were mechanically spun from staple tow. Schipper relies on using two filaments that have different stretch potentials, thus one is fully stretched and breaks when drawn further in a second step while the other does not break and is used as a vehicle to carry the broken filaments. This is shown clearly in FIG. 4 where an edge roller is used to draw stretch and break some filaments. While this concept may be useful in the apparel and sweater trade, the weakness of the yarns produced using this method would prohibit them from being used as a carpet yarn.

While teaching specific sheath-core technology techniques the forgoing patents do not address the characteristics necessary for the manufacture of a dyeable carpet face yarn. More specifically, both cost and performance characteristics of each of the above prohibit teaching or suggesting use as commercial carpet yarns.

SUMMARY OF THE INVENTION

The present invention relates to a synthetic bi-component multifilament carpet face yarn that can be dyed using standard atmospheric dyeing pressures. This yarn is meant for use as a dyeable face yarn in the tufted carpet industry.

The bi-component yarn is melt spun of the sheath-core type, wherein which the core is preferably made from an inexpensive material not ordinarily used in the manufacture of piece dyeable carpet yarn.

For example, the core can be polyethylene terephthalate, polyethylene terephthalate recovered from plastic soda bottles, polyester polyvinyl chloride. Plastic soda bottles collected "curbside" contain a variety of colored PET. Until now, only the clear PET is acceptable for reprocessing into textile material. This invention can use colored or tinted material in the core, as well as clear. The sheath is dyed and masks the tinted inner core. Using this tinted or colored reclaimed resin is both economical and environmentally beneficial.

The sheath is a virgin polyamide such as Nylon 6 or 6/6 polymer that is currently used as a material in the carpet industry to create a dyeable carpet yarn.

The virgin nylon sheath is the expensive portion of this new yarn. It is desirable to use only as much nylon as necessary to achieve the desired effect. We have determined that as little as 20% virgin nylon by weight can be used as the sheath to create a piece dyeable carpet yarn. By raising the volume by weight of virgin nylon in the sheath, the depth of shade during dyeing can be increased. We have found that a sheath of nylon 30% to 50% by weight is the ideal range for the sheath.

The core portion of this invention has several prerequisites. The polymer must have fiber forming characteristics. The core polymer must be cleaned sufficiently enough to pass through the melt spinning process without unduly clogging the fiber forming spinnerettes and be able to form a continuous fiber in conjunction with the nylon. This allows use of polymers not usually found in the carpet industry and the use of "off spec" or reclaimed polymers. This invention will accept colored or tinted reclaimed polymers usually included in community curbside recycling efforts. The invention relies on the nylon portion of the filaments to create the characteristics required in a dyeable carpet face yarn and the inner core for a foundation to support the outer sheath of nylon. When it is dyed in further processing, the sheath portion of the fibers mask the tinted colors such as green or orange found mixed in with the clear plastic soda bottles collected at curbside. The inner core must not be dyeable under standard atmospheric pressure therefore polypropylene, polyethylene terephthalate, high density polyethylene, polyester or polyvinyl chloride will work.

DETAILED DESCRIPTION OF THE INVENTION

Process for producing a multifilament yarn composed of a plurality of filaments melt spun by the sheath core method substantially using marginal material in the core and virgin polyamide nylon 6 or 66 as the sheath that is suitable for use as a dyeable carpet face yarn in the tufted carpet industry.

EXAMPLE 1

Flakes of polyethylene terephthalate are obtained from a commercial plastic beverage bottle recycling facility. The flake is prepared from plastic beverage bottles shredded and cleaned according to known standards set forth in Tomazek U.S. Pat. No. 4,728,045 and Hannigan Fernandas, et al. U.S. Pat. No. 4,830,188

The cleaned flake is dried at 250 F. for four hours and is fed to an extruder which will melt the polymer and pass it through a 150 mesh screen that operates on a continuous basis and filters the polymer to remove minute particles of grit, aluminum, charred plastics, and adhesives, glass etc. that has not been removed in the washing process. This material will be pelletized in the same process and collected in gaylord containers or silos common to the industry. With a specially built cram feeder to supply the extruder, flake can be used to feed a fiber extruder instead of pellets.

This material now has a heat history from the bottle process, the washing process and the re-extrusion process and is considered marginal. The intrinsic viscosity will be in the 0.60 to 0.70 range.

Just prior to extruding in a fiber extruder the pellets are thoroughly dried in a fluid bed drying apparatus to remove 99.50% to 99.9% of all water moisture from the polymers. A temperature range of 250 F.–350 F. is maintained for four hours. This achieves enough crystallization to allow the pellets to be successfully extruded.

This crystallized material is fed directly to an fiber extruder which is attached to a spin pack designed to feed two molten polymers simultaneously to a spinnerette.

A second extruder attached to the above spin pack is fed nylon that is thoroughly dry and ideally covered with a nitrogen blanket in the hopper that is feeding the spin pack.

Thus there are two extruders feeding a single spin pack. The polyethylene terephthalate is molten by one extruder and the polyamide is molten by the other. Temperature ranges are adjusted to those well known in the art of fiber extruding.

The spin pack shall be that well known in the art and shall feed spinneretes to create a filament that has a core of polyethylene terephthalate 70% by weight and a sheath of polyamide (nylon 6) which is 30% by weight. This percentage can be varied by varying the polymer volume fed to the spin packs feeding the spinnerette. The sheath should not fall below 20% by volume or the resultant yarn will not be suitable for tufted carpet face yarn.

The molten filaments reach a temperature of 290 C. for Nylon 6 and 300 C. for polyethylene terephthalate. The molten material will be a sheathed core plurality of filaments with each individual filament being at least 60 denier. In this example there were one hundred and forty four filaments being drawn at 1000 meters per minute. The total bundle was measured to be 9100 denier.

At a second stage of the machine, the 9100 denier 144 filament bundle was passed over godets or heated rollers designed to stretch or draw the filaments to their full potential which is 1:3.5 or 1:4. The resultant size of the continuous filament yarn bundle will be at least 2400 denier and each filament would be 16 denier. Any further elongation will break the filaments and this is not desirable. Drawing the yarn at this speed orients the crystals and makes the yarn strong.

It is extremely important not to break any filaments and to have each and every endless continuous filament as uniform in size a possible. Broken filaments will cause problems in further processing the yarn on other carpet making equipment. To help facilitate the drawing of the yarn, steam at atmospheric pressure was fed into the yarn feed tube. This helps to avoid broken filaments when drawing.

While draw stretching the yarn over godets, the yarn was fed to an air jet nozzle designed to bulk or crimp the yarn filaments. This is accomplished by feeding the yarn in slightly faster than drawing it out. The yarn then is passed over a cooling apparatus and wound onto a tube to form a yarn package on a continuous basis.

The resultant product was a yarn wound on a ten pound cardboard tube composed of a plurality of 144 sheath core continuous filaments that measured at least 15 denier. The core which is 70% of the material by weight, contained substantially washed and melt filtered marginal polyethylene terephthalate that was reclaimed from the post consumer recycled plastic soda bottle waste stream. The sheath comprising 30% by weight of virgin polyamide nylon 6 that can be dyed using standard atmosphere pressure.

The yarn would be described as a bulked endless 2600 denier filament composed of 144 endless sheathed core filaments for use as a face yarn in tufted carpet. Other carpet yarn sizes such as 1000 denier to 3300 denier can be manufactured using the same process. If it is desirable to manufacturer a smaller denier sheath core bulked continuous filament, then the above procedures would have to be changed.

The resultant yarn is piece dyeable and uses less dye than a 100% polyamide nylon yarn. The sheath is the only dyeable material when using acid dyes at standard atmospheric pressure. In this example, the sheath is 30% by weight of the total weight, therefore the yarn will only require 30% of dyestuff and chemicals normally used in the dyeing process.

By sheathing the core with polyamide before texturing the yarn, the invention has achieved something not previously suggested or anticipated. The nylon sheath serves to hold the crimp or texture in the yarn. Without the nylon as a sheath, the texture or crimp could be easily pulled from the yarn making it unfit for use as carpet face yarn. Therefore, the new carpet yarn disclosed herein in effect utilizes the characteristics of nylon as a carpet yarn but at a fraction of the cost of using 100% nylon.

A substantially further reduction in cost is achieved when the core material is manufactured from green or tinted plastic recovered from the post consumer recycling waste stream. This material is not saleable at full price to other industries as they require clear undyed or uncolored material for their process.

The yarn is manufactured using a continuous process and is ready to be used as face yarn by the carpet industry with out further processing such as spinning or carding.

The yarn was set up on a carpet tufting machine and was tufted into a primary carpet backing at six stitches to the inch on a one quarter gauge sample tufting machine. The pile height was set at approximately one half inch. The resultant carpet sample was piece dyed to a popular shade of light brown and then was backed on a carpet backing range. The carpet appeared normal in every respect.

During the tufting of the carpet nothing unusual was observed. The machine operators saw no difference between the yarn made under this new process or that of regular polyamide (nylon 6 carpet yarn.

A sample of the carpet was submitted for testing to a well known Georgia testing laboratory in Dalton Georgia. The carpet was tested for its ability to withstand and recover from crushing. There is a direct correlation between crush recovery and the ability of the carpet to withstand compression from foot traffics.

Tests for compression and recovery were performed with a load of 35 pounds per square inch maintained for 48 hours. The total product thickness was determined using a Scheifer Compressometer equipped with a one inch diameter presser foot under a force of 0.22 pounds per square inch. Thickness was measured prior to compression and after 48 hours compression time. The load was removed and the thickness was measured immediately and at various intervals as listed below. The test was conducted under standard conditions for testing textiles.

| | Test Results | | |
|---|---|---|---|
| | Time (hours) | Total Thickness (inches) | Percent of Original Thickness % |
| compression | 0.00 | 0.478 | 100.0 |
| | 48.00 | 0.346 | 72.4 |
| Recovery | 24.00 | 0.429 | 89.7 |
| | 48.00 | 0.437 | 91.4 |
| | 72.00 | 0.443 | 92.7 |
| | 96.00 | 0.445 | 93.1 |
| | 120.0 | 0.446 | 93.3 |

The above test results were compared to a sample made from 100% polyamide nylon 66 subjected to the same conditions. Tufting was the same and dying and finishing performed under similar conditions resulted in a product indistinguishable from 100% nylon. The results showed that the carpet made using the invention was equal to comparable tufted carpet made with face yarns using 100% polyamide nylon 66.

The invention using a core of marginal materials and a sheath of polyamide nylon 6 produced high quality tufted carpet face yarn using the prescribed procedures as described.

EXAMPLE 2

Using the prescribed method of extrusion according to the invention, a core of green PET recovered from plastic beverage bottles and processed properly was used to create a sheath core BCF continuous filament carpet face yarn. The continuous filament carpet yarn contained 144 filaments of at least 16 denier each and its overall size was 2600 denier. The resultant undyed yarn appeared as a light green color since the core was visible through the almost clear nylon sheath.

The yarn was tufted on a sample tufting machine create a level loop pile carpet that was light green in appearance. Part of the sample carpet was then cut to 3 inch×5 inch swatches and subjected to standard nylon laboratory dye baths. Colors were applied using acid dyes in a standard manor using the exhaust method of dying. The samples were exposed to dying at the boil for thirty minutes.

The yarn dyed to depth of shades not expected. They were dyed a light brown to a deep burgundy red shade using the standard methods. None of the samples showed any sign of the green core. The sheath of nylon 6 dyed to a depth of shades that was enough to make the green core invisible to the naked eye.

The same dye formulas were repeated on identical samples using 100% polyamide nylon 6 carpet face yarns. The shades achieved had 50 to 70% less depth than the sheath cored face yarn. This experiment shows that the new continuous filament yarn will require less dye stuffs and chemicals when dying carpet made from yarn using the invention. This is due to the fact that the dye is not dispersed throughout the entire cross section of the fiber. The PET sheath core does not attract any of the acid dyes used to dye polyamide nylon and allows all the dye to concentrate on the nylon portion of the carpet yarn.

EXAMPLE 3

A BCF continuous sheath core yarn was made according to the above described methods of the invention. The core was a clear PET material processed according to the invention. It was transparent and was recovered from beverage bottles. Polyamide nylon 6 was used a sheath material.

The yarn was made into a standard knitted sleeve and printed with a pale green, a pale orange and a pale blue shade using the knit de knit method of space dyeing. The dye formulas used contained 50% less dyes than those required to achieve the same shade on 100% polyamide nylon 6. The resultant yarn was a space dyed yarn that appeared to be the same as a 100% space dyed nylon carpet yarn.

The yarn was then twisted with three ends of untreated yarn made according to the above invention. A separate yarn was created using the yarn according to the invention and three untreated yarns made from 100% dyeable nylon 6.

Both composite yarns were tufted into separate 36 inch wide by 24 four foot long sample carpets. Using a pile height of one half inch and a stitch rate of six stitches per inch on a one quarter gauge tufting machine.

The resultant greige goods appeared as a level loop pile carpet with pale orange, pale blue and a pale green overall spotted effect known to the carpet trade as "BERBER" carpet.

Both samples were subjected to the same pale brown dye formulas and dyed simultaneously on a continuous dye range. The samples were dried, backed and inspected.

The carpet made with 100% sheath core face yarn according to the invention dyed to a 50% greater depth of shade than that of the carpet made using a majority of 100% polyamide nylon 6. No special care had to be accorded the new yarn vs the standard carpet nylon.

In the embodiment of the present invention described above, it is clear that the invention provides for the first time a means to create a tufted carpet costing substantially less to manufacture due to the fact that the face yarn costs less to manufacture but behaves substantially the same as carpet manufactured using 100% polyamide nylon.

In addition to costing less to manufacture the carpet face yarns, the carpet manufacturer will save at least 30% to 70% when dyeing or treating the carpet. Since the core of the sheath core yarn is made from a polymer that will not accept acid dyes or any dyes applied at standard atmospheric pressures only the sheath will have to be dyed to obtain the decorative shades used in the carpet and home furnishings industry.

Another application anticipated by this invention is its use to create automotive carpets. Most automotive carpet is made from bulked continuous filament nylon. Bulked continuous nylon is used because it has strength, bulking coverage, and compression recovery. Most automotive carpet is manufactured using the tufting process and is then subject to high temperatures during the "molding" process. An important characteristic for automotive carpeting is color fastness and stain resistance. It is known that polyester yarns are inherently ultraviolet light stable and ozone gas resistant. Therefore, Polyester yarns would be better qualified as an automotive carpeting raw material. However polyester is not available in bulked continuous filament yarn form for automotive use because polyester has poor crush recovery characteristics. This invention produces a bulked continuous filament yarn that can be used for automotive carpeting because the nylon sheath provides the necessary compression recovery characteristics. The fact that the core can be made of polyester makes a combined automotive carpet yarn with the stain resistance and light fastness of polyester and the crush recovery of nylon. Automotive carpeting would be tufted into greige goods and then dyed. The tufted greige goods must be dyed at substantially above normal atmospheric pressure so that the polyamide and the polyester would dye to a single solid shade. High energy dye stuffs currently used in dyeing polyester would dye the nylon sheath and polyester core into a fade resistant color with the previously mentioned qualities desirable in automotive carpet. However, using this invention would save at least 30% in raw material costs compared to 100% bulked continuous filament nylon. The costs have factored in the higher costs to dye at increased pressure.

What is claimed is:

1. A carpet tufted with a bulked continuous filament carpet face yarn, wherein said yarn comprises:

a) a bundle of drawn and crimped bi-component filaments;

b) each filament consisting essentially of an outer sheath of nylon surrounding a core consisting of fiber forming polymeric material;

c) said nylon sheath constituting from twenty to fifty percent of the total weight of each filament wherein said polymeric core constitutes the remainder of the total weight of each filament;

d) said nylon sheath being dyed under standard atmospheric pressure using nylon dye techniques and said polymeric core material being undyeable under standard atmospheric pressure using said nylon dye techniques;

e) wherein the percentages of nylon and polymeric material in combination impart the properties of recovery from crushing or compression; the ability to be tufted at high speeds; the ability to apply desired color on conventional dyeing equipment at atmospheric pressure; strength to resist heavy foot traffic; and good bulking properties equivalent to those of a bulked continuous filament carpet face yarn consisting of 100% nylon.

2. The carpet according to claim 1 wherein said polymeric core consists of fiber forming material that is a material not ordinarily used in the manufacture of piece-dyable carpet yarn.

3. The carpet face yarn according to claim 1 wherein said polymeric core material is fiber-forming polypropylene.

4. The carpet face yarn according to claim 1 wherein said polymeric core material is fiber-forming polyethelene terephthalate.

* * * * *